US006311792B1

(12) United States Patent
Scott et al.

(10) Patent No.: US 6,311,792 B1
(45) Date of Patent: Nov. 6, 2001

(54) CASING CLAMP

(75) Inventors: Stephen F. Scott; Kevin Nikiforuk, both of Calgary (CA)

(73) Assignee: Tesco Corporation, Calgary (CA)

( * ) Notice: Subject to any disclaimer, the term of this patent is extended or adjusted under 35 U.S.C. 154(b) by 0 days.

(21) Appl. No.: 09/414,482

(22) Filed: Oct. 8, 1999

(51) Int. Cl.[7] ..... E21B 17/02
(52) U.S. Cl. ..... 175/162; 166/85.1; 166/379
(58) Field of Search ..... 175/162, 171; 166/77.1, 85.1, 85.2, 89.3, 88.2, 379

(56) References Cited

U.S. PATENT DOCUMENTS 4,646,827 3/1987 Cobb .
4,936,382 6/1990 Thomas .
5,305,839 4/1994 Kalsi et al. .
5,332,043 7/1994 Ferguson .
5,706,894 1/1998 Hawkins, III .
5,971,086 * 10/1999 Bee et al. ..... 175/423
5,988,273 11/1999 Monjure et al. .
6,142,545 * 11/2000 Penman et al. ..... 294/86.15

FOREIGN PATENT DOCUMENTS

WO99/30000 6/1999 (WO) .

* cited by examiner

*Primary Examiner*—William Neuder
(74) *Attorney, Agent, or Firm*—Bennett Jones LLP

(57) ABSTRACT

A clamp for gripping casing strings is disclosed. A series of radially arranged spring biased slips are mounted in a housing attached to a top drive. A hydraulic system is used to release the slips from the gripping position upon a casing string.

32 Claims, 4 Drawing Sheets

CASING CLAMP

FIELD OF THE INVENTION

The present invention relates to a device for driving and handling a drillstring, and, in particular, for manipulating a casing string in a casing drilling environment.

BACKGROUND OF THE INVENTION

The drilling of wells, such as those for oil and gas often use a top drive to turn the drillstring. The quill of the top drive typically threads into the box end of the top joint of pipe used for drilling and in turn drives the pipe. The problem encountered is that there is potential for damage to the threads of both the drill pipe and the top drive quill. Galling of the threads is undesirable, since they have to be machined to correct the damage, which is time consuming and costly, especially given the typically remote locations that wells are drilled in. It is especially desirable to avoid damaging the threads on the top drive, since they are much more difficult and expensive to repair than drill pipe.

With the development of drilling with casing, that is using a casing string as the drill pipe, the issue of thread protection has become much more important. This is because the thread form used in casing connections is more fragile than the connections used in drill pipe, and the casing connections have to remain fluid and pressure tight once the drilling process has been completed. Other considerations are that casing typically has a thinner sidewall and is less robust than drill pipe. This is especially true in the thread area, where the casing has threads on both ends, with a corresponding reduction in section area.

While some clamps are available for gripping casing, these clamps grip the casing on the inside using expandable jaws. These clamps are therefore not suitable for use in manipulating casing during a casing drilling operation. The expandable jaws create a severe restriction on the casing's inner diameter which restricts mud flow downhole, for example, to a downhole motor which may restrict the amount of power the motor is capable of producing. In addition, the jaws are not fail safe, since a biasing agent must be continuously applied to maintain gripping force. Prior casing clamps had no means for passing fluids to the casing bore and had no means for manipulating the casing simultaneously in vertical and rotational directions.

Other prior methods of handling casing involved using the kelly or top drive to turn the casing, with the attendant risk of damage to the threaded connections. A safer and more efficient system of driving a casing string is needed.

SUMMARY OF THE INVENTION

The present invention provides a clamp for driving a drillstring where the drillstring is formed of casing pipe. While the clamp is described herein exclusively for use with casing, it should be understood that the clamp might be used in other applications. By utilising a casing clamp device of the present invention, the risk of damage to the threaded connection on the ends of the casing is minimised. The clamp includes a sealing element to enable drilling mud to be pumped down the centre of the pipe while rotating the pipe during drilling operations. In addition, the clamp permits simultaneous displacement of the pipe, either up or down, while rotating it, which is an essential requirement of drilling.

In accordance with a broad aspect of the present invention, there is provided a clamp for use with a top drive for gripping and turning a drillstring formed of pipe, the clamp comprising: slips positioned to grip the pipe, drive means for moving the slip blocks and dies radially inwardly into a pipe gripping position and radially outwardly to a pipe releasing position, and an attachment means for connecting the apparatus to a top drive.

The slips are preferably formed, for example including a toothed or otherwise knurled face, to enhance their engagement against the outer surface of a pipe. The slips can be replaceable to accommodate different sizes of pipe and to enable the gripping surface to be renewed as it wears. In one embodiment, the slips carry slip dies. The slip dies are selected to engage a pipe disposed between the slips and, therefore, can be roughened or formed with teeth to enhance their engagement with the pipe outer surface. The slip dies can be carried on the slips in such a way as to be replaceable.

In one embodiment, the slips are mounted in a slip bowl and are constrained to move along a conical taper of the slip bowl to, thereby, be moved radially inward and outward relative to the centre axis of the slip bowl. This permits the slips to be moved to grip or release a pipe positioned therebetween. The conical taper is positioned to taper downwardly such that as the weight on the pipe increases, the slips will be driven to bite with increased force into the pipe.

The drive means can be any suitable means for moving the slips radially inwardly and outwardly, for example, in one embodiment along the taper of the slip bowl. In one embodiment, the drive means includes a biasing agent such as, for example, a plurality of springs that bias the slips down the taper of the slip bowl such that they are normally in a pipe gripping, closed position. Thus, unless a force is applied against the pressure in the biasing agent, the slips remain in a pipe gripping position reducing the chance of a pipe being inadvertently released. In order to move the slips to an open position to release a pipe, the drive means includes a system for applying force against the biasing agent. The system for applying force can, for example, use hydraulics.

The clamp is attached to a top drive by an attachment means. The attachment means is selected to be capable of transferring torque from the top drive to the clamp to cause it to rotate. In one embodiment, a quill adapter is connected to the clamp and formed at its outboard end for engagement to the quill of the top drive.

In one embodiment, the clamp includes a stabbing spear extending out to fit into a pipe and align it with the slips to facilitate gripping. In another embodiment, a drilling fluid conduit is provided for conducting a flow of drilling fluid into the longitudinal bore of the pipe. Preferably, the stabbing spear is formed as a conduit so that it can also serve as the drilling fluid conduit. In such an embodiment, the stabbing spear includes seals for acting between the spear and the pipe for restricting the flow of drilling fluid outside of the pipe. The spear also acts as a mandrel, enhancing the casing's ability to withstand large inward clamping forces without deforming the pipe.

When the clamp is rotated, the slips rotate therewith and, therefore, any pipe gripped by the slips is also rotated.

In accordance with another broad aspect of the present invention, there is provided a method for drilling a well with a well casing as an elongated tubular drill string and a drilling assembly retrievable from the lower distal end of the drill string without withdrawing the drill string from a wellbore being formed by the drilling assembly, the method comprising: providing the casing as the drill string; providing a drilling assembly connected at the distal end of the drill string and being retrievable through the longitudinal bore of the drill string; gripping the drill string on its outer surface; inserting the drill string and the drilling assembly into the wellbore and driving the drilling assembly to operate to form a wellbore to a diameter greater than the diameter of the drill string.

Preferably the method further includes: removing at least a portion of the drilling assembly from the distal end of the drill sting and moving the at least a portion of the drilling assembly out of the wellbore through the drill string without removing the drill string from the wellbore, leaving the drill string in the wellbore.

The drilling assembly can be any assembly useful for drilling a wellbore through an earth formation. As would be appreciated, the drilling assembly can include a drill bit and any of, for example, measurement while drilling equipment and a downhole motor.

In a preferred embodiment, the step of gripping the drill string is accomplished by providing a clamp according to the present invention as described hereinbefore. Preferably, the method further comprises, after the step of inserting; pumping drilling fluid through the longitudinal bore of the drill string. In one preferred embodiment, the drill string is gripped and moved upwardly or downwardly while being rotated.

BRIEF DESCRIPTION OF THE DRAWINGS

A further, detailed description of the invention, briefly described above, will follow by reference to the following drawing of a specific embodiment of the invention. This drawing depicts only a typical embodiment of the invention, and is therefore not to be considered limiting of its scope. In the drawings.

DETAILED DESCRIPTION OF THE PRESENT INVENTION

Figure 1:
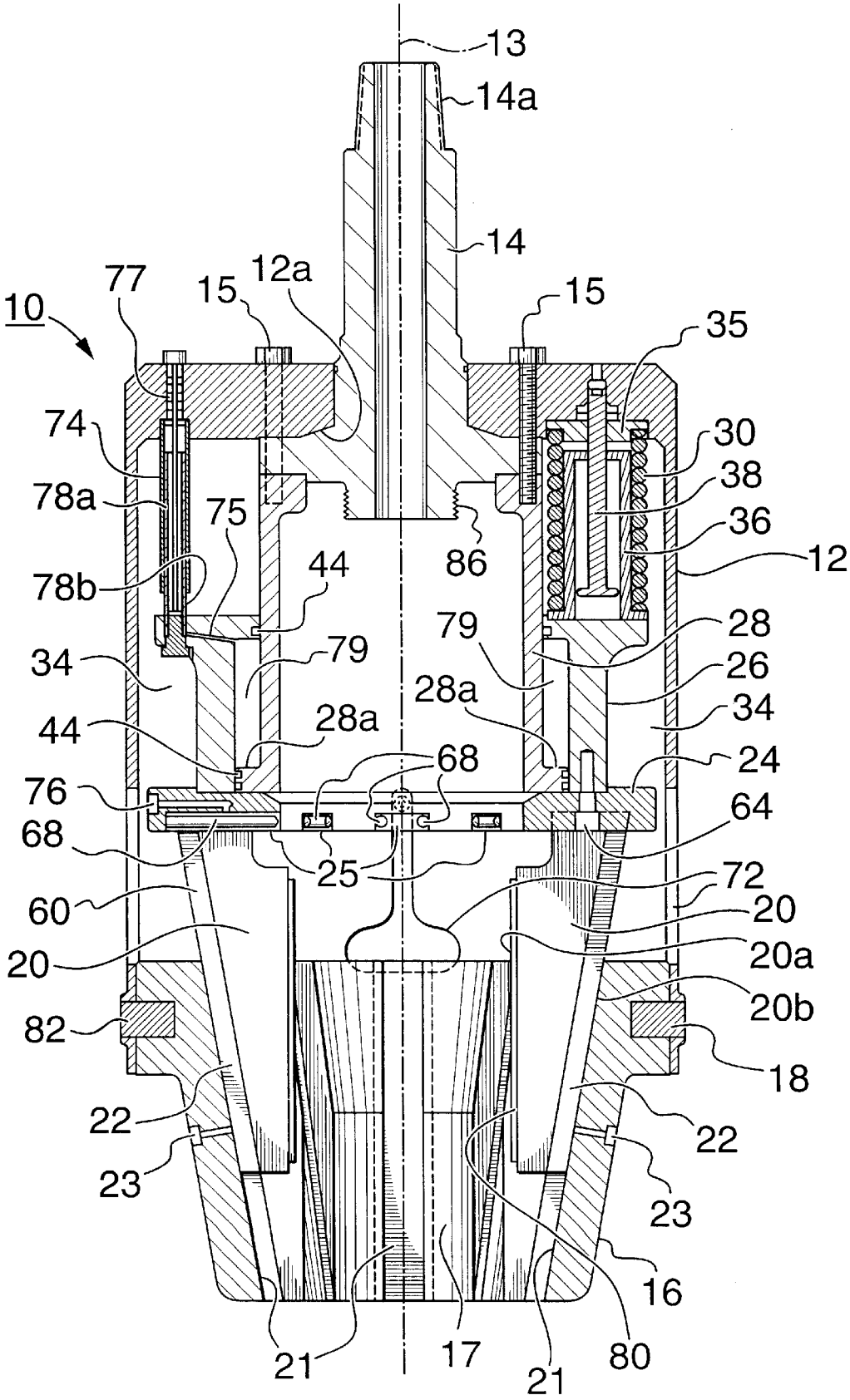
FIG. 1 is a cross sectional view through a casing clamp according to the present invention with the slips (to facilitate understanding only two slips are shown) in the fully retracted position, useful during insertion or removal of casing from the clamp.

The drawing figures are not necessarily to scale, and certain features are shown in generalised form in the interests of clarity.

Figure 2:
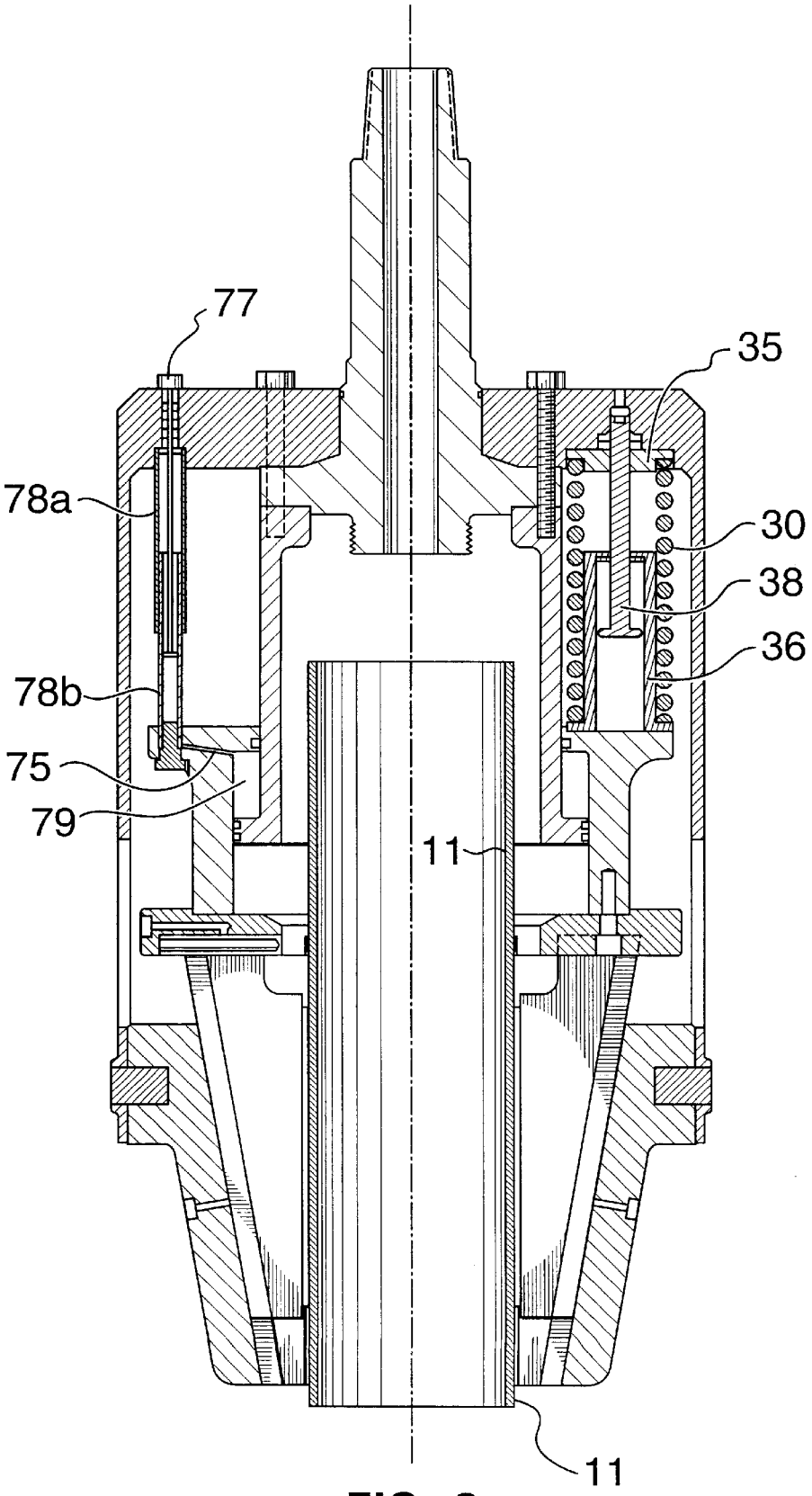
FIG. 2 is a view of the casing clamp of FIG. 1 with the slips closed upon a piece of casing and ready to drill.
Figure 3:
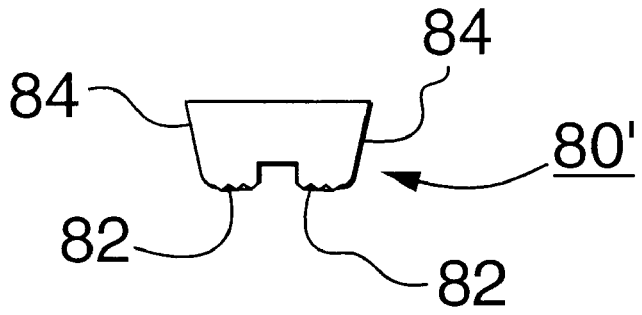
FIG. 3 is an end view of a slip die useful in the present invention.

As shown in FIGS. 1 to 3, casing clamp 10 according to the present invention is formed to grip a pipe 11 (FIG. 3) and to be carried on a top drive (not shown) such as, for example, a model no. HMI 200 available from Tesco Corporation. The pipe is a portion of a drill string formed of casing. The casing clamp serves as a load path to transfer the weight of pipe 11, and the remainder of the drill string extending therefrom, to the top drive and to transmit the full torque applied from the top drive to the pipe and therethrough to the drillstring.

Casing clamp 10 includes an outer housing 12 having a central axis 13. A quill adapter 14 is attached to outer housing 12 at its top end and is positioned coaxially with central axis 13. At its outboard end 14*a,* quill adapter 14 is threaded for threaded connection to a top drive quill (not shown). The casing clamp is supported by the top drive through quill adapter 14.

Housing 12 includes an opening 12*a* to accept and facilitate positioning of the quill adapter in the housing during assembly. Quill adapter 14 is attached via bolts 15 to housing 12. Bolts 15 thread through aligned holes in housing 12 and quill adapter 14. Bolts 15 finally engage in threads formed in inner piston housing 28 disposed within the housing. In this mounting arrangement, quill adapter 14 is mounted between outer housing 12 and inner piston housing 28.

A slip bowl 16 is rigidly connected to the lower end of housing 12 by means of locating dowels 18. Slip bowl 16 defines a central conical bore 17 that is concentric with central axis 13. Conical bore 17 is tapered downwardly to define, for example, a 4:12 ratio taper between the opposing slips, or 2:12 taper for each individual slip.

While only two dowels 18 are shown, preferably there are eight dowels spaced about the periphery of the slip bowl. Dowels 18 are removable to facilitate removal of the slip bowl from housing 12. Dowels 18 are formed to transfer any weight on the slip bowl to housing 12. This weight is in turn transferred to the top drive.

Slips 20 are mounted in spaced apart relation about slip bowl 16. Although only two slips are shown, in the preferred embodiment there are eight slips. The slips are wedge shaped having substantially flat faces 20*a* and sloping back surfaces 20*b* which conform to the taper of conical bore 17. Slips 20 are mounted in the slip bowl by dove tailed slots 21 which accept correspondingly shaped extensions 22 formed on the back of the slips. Dove tailed slots 22 extend vertically to permit the slips mounted therein to ride upwardly and downwardly along the taper of the conical bore and to, thereby, move radially toward or away from central axis 13. When the slips 20 are fit into their slots 21 they can ride along the taper but are substantially prevented from rotating relative to the slip bowl about the central axis. To provide for lubrication of the slips, a grease nipple is provided in a bore 23 opening into each slot 21.

Slips 20 are prevented from dropping out of slots 21 by attachment to a ring-shaped push plate 24. Push plate 24 abuts against the upper surface of slip bowl 16 limiting the extent to which slips 20 can move downwardly in their slots. Slips 20 are slidably mounted in slots 25 formed in the push plate and connected to the push plate 24 by means of bolts 68. The bolts are formed to secure the slips from moving along axis 13 relative to push plate 24, while allowing the slips to move relative to the push plate radially inwardly and outwardly to accommodate the movement of the slips on the taper. Bolts 68 are accessible through apertures 72 in outer housing 12 when the slips are in the fully extended position. Also accessible through the apertures 72 are grease nipples 76 for applying grease to slots 25 to lubricate movement between the slips and the push plate.

Push plate 24 is connected to a drive means for moving the slips along their slots. In the illustrated embodiment, the drive means includes an annular ram 26 onto which push plate 24 is connected as by bolts or welding.

The drive means further includes a hydraulic system for driving the slips against the force of springs 30. In particular, a chamber 76 formed between ram 26, inner piston housing 28 and annular flange 28*a* accepts oil through oil supply tube 74 and channel 75. Seal rings 44, for example, Poly Pak rings available from Parker Hannifin Corp, Cleveland, Ohio, ensure that the hydraulic fluid is contained in chamber 76.

Oil supply tube 74 is in communication with a connector 77 for connection to an external hydraulic system (not shown) including hoses, a source of hydraulic fluid, pumps and control valves etc. Oil supply tube 74 is formed of telescopically arranged members 78*a,* 78*b* such that it can extend between its fixed positions on housing 12 and annular ram 26.

Annular ram 26 extends out from and is selected to ride within a torus shaped chamber 34 defined between housing 12 and inner piston housing 28. Chamber 34 contains a plurality of compression springs 30 which act between housing 12 and annular ram 26 to bias the annular ram downwardly toward push plate 24. In one embodiment, ten compression springs are spaced apart within the chamber. Annular ram 26 is prevented from being forced completely out of chamber 34 by abutment against an annular flange 28*a* on inner piston housing 28. Each compression spring is preferably preloaded by use of a limiter including an end plate 35 and an end cup 36 connected by a drawbolt 38. End cup 36 is formed to slidingly accept an end of drawbolt 38, while drawbolt 38 is rigidly connected to end plate 35. Preloading facilitates assembly of the clamp and permits the tension in the springs to be selected and adjusted.

The drive method further includes a hydraulic system for driving the slips against the force of springs 30. In particular, a chamber 76 formed between ram 26, inner piston housing 28 and annular flange 28*a* accepts oil through oil supply tube 74 and channel 75. Seal rings 44, for example, Poly Pak rings available from Parker Hannifin Corp, Cleveland, Ohio, ensure that the hydraulic fluid is contained in chamber 76. Oil supply tube 74 is in communication with a connector 77 for connection to an external hydraulic system (not shown) including hoses, a source of hydraulic fluid, pumps and control valves etc. Oil supply tube 74 is formed of telescopically arranged members 78*a,* 78*b* such that it can extend between to its fixed positions on housing 12 and annular ram 26.

In operation, slip dies 20 are normally biased toward the closed, casing gripping position (FIG. 2) by spring pressure exerted through annular ram 26 and push plate 24 to slips 20. It is preferred that the slip dies are biased in this way to prevent inadvertent release of pipe 11 which is gripped therebetween, as well to ensure that the grip upon the pipe will not slacken off while drilling or tripping.

Applying oil pressure to chamber 76 forces annular ram 26 upward against the tension in springs 30. Annular ram 26 draws push plate 24 and the slips attached thereto upward. To return the slips 20 to the casing gripping mode of operation the hydraulic fluid pressure is released through the channel 75 and oil supply tube 74. This permits the force in springs 30 to drive the annular ram and, thereby the slips, back to the gripping position.

Figure 4:
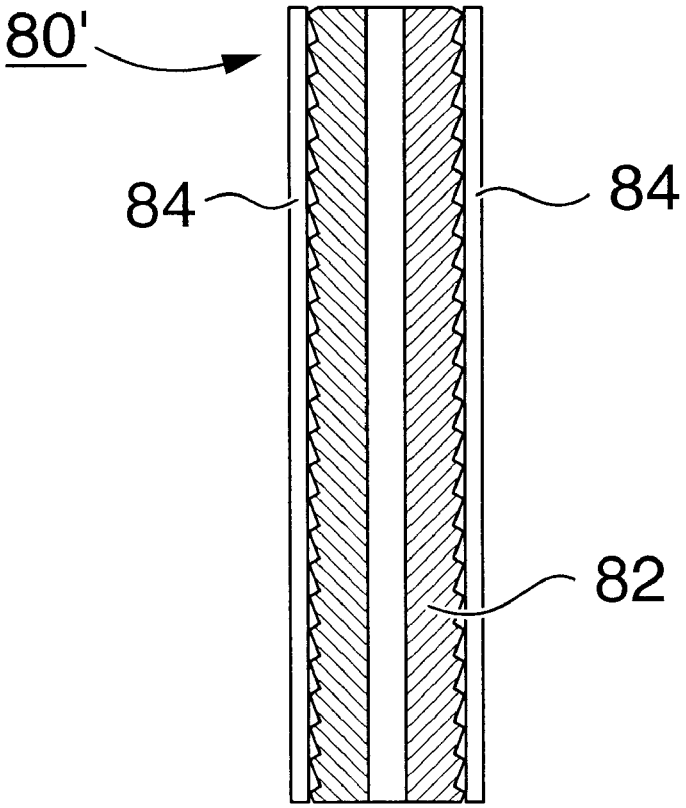
FIG. 4 is a plan view of the slip die of FIG. 3.

Faces 20*a* of slips can be formed to engage against pipe 11. However, in a preferred embodiment as shown, the slips can support slip dies 80, which are knurled or roughened to facilitate engagement against pipe 11. Slip dies 80 are preferably removable so that it is possible to accommodate different sizes of pipe through alternating slip die thicknesses and/or surface curvature, and for repair and replacement. One embodiment of a slip die 80' is shown in FIGS. 3 and 4. Slip dies 80' have a herringbone pattern arrangement of elongate teeth 82 so that the casing can be securely gripped while both turning (i.e. rotating it about axis 13) and advancing the casing into the borehole (i.e. moving the casing along axis 13). Slip dies 80' mount to slips 20 via dovetailed extensions 84 and retaining bolts (not shown).

Figure 5:
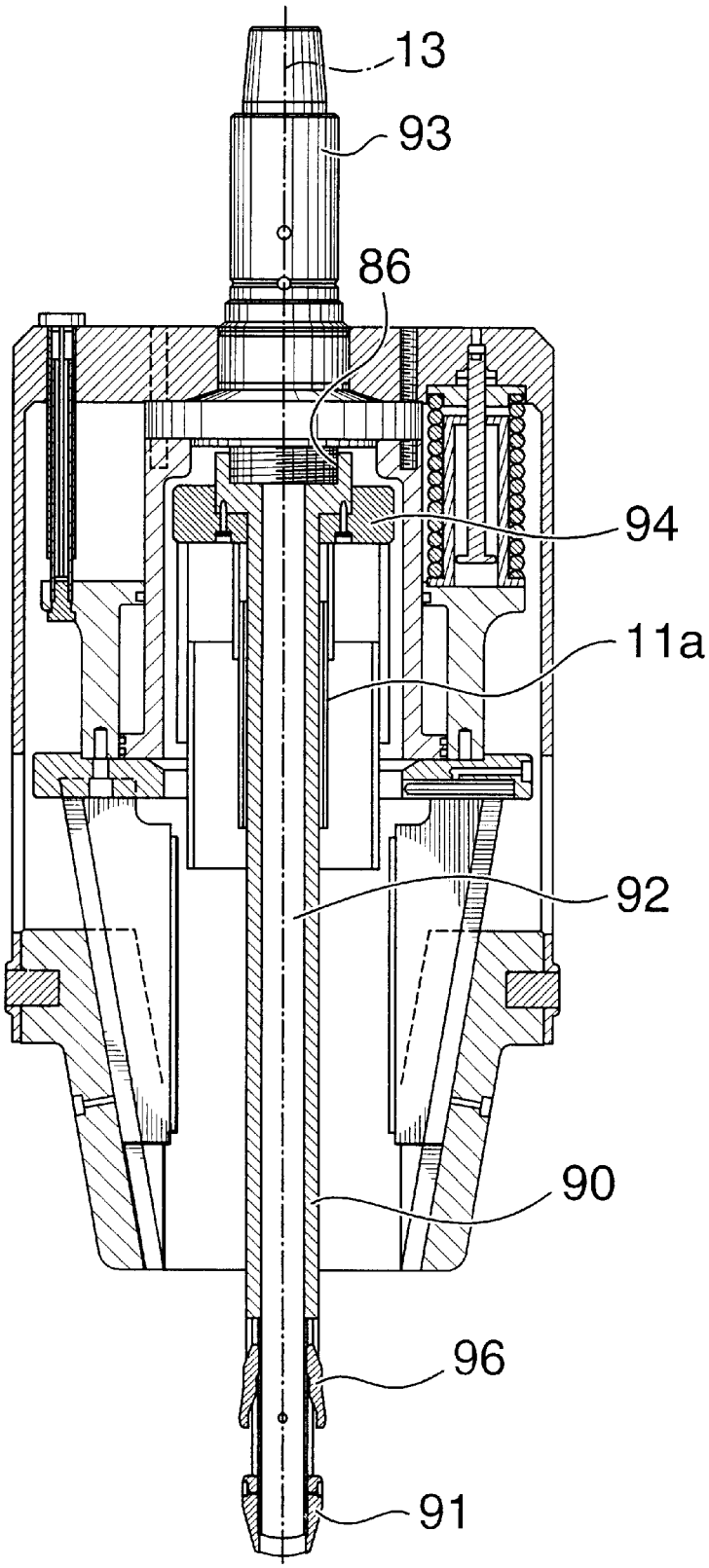
FIG. 5 is a cross sectional view through another casing clamp including a stabbing spear.

Threads 86 on quill adapter 14 are formed to engage a stabbing spear 90, as shown in FIG. 5. Stabbing spear 90 extends in alignment with central axis 13 and is sized to fit into the bore of pipe 11*a* (shown only as a short piece and including a coupling threaded thereon). Using spear 90 the pipe to be gripped can be centralised as it is being offered up to the clamp. A tapered ring 91 is mounted at outboard end of stabbing spear 90 to guide the stabbing spear into the bore of the pipe.

Stabbing spear 90 includes a bore 92 which, when spear 90 is mounted on threads 86, aligns with bore 93 of quill adapter 14. Together bore 93 and bore 92 act as a conduit through which drilling fluid can be pumped from the top drive to the bore of pipe 11 and then downhole. A seal ring 94 on stabbing spear 90 seals to the end of pipe 11. Another seal 96, in the form of a packing cup, is disposed about stabbing spear 90 and is selected to seal between the stabbing spear and the pipe. Seals 94 and 96 act to substantially prevent the leakage of fluid out of pipe 11 as it circulates from quill 14 into the pipe 11.

The drill string is advanced and rotated by the casing clamp in a manner similar to what is used in conventional top drive drilling where the pipe is attached to the top drive and is rotated as well as advanced into the borehole by the top drive. The casing clamp is attached through quill adapter end 14*a* to the quill of the top drive, and rotates with the top drive's quill. When the drillstring is gripped by the casing clamp, the drillstring rotates in unison with the top drive. Since the drillstring is securely gripped by the casing clamp the drillstring is either lowered into or raised out of the wellbore as the topdrive is raised or lowered.

Although preferred embodiments of the present invention have been described in some detail hereinabove, those skilled in the art will recognise that various substitutions and modifications may be made to the invention without departing from the scope and spirit of the appended claims.

What is claimed is:

1. A clamp for use with a top drive for gripping and turning a drill string formed of pipe, the clamp comprising: slips positioned to grip and support the pipe, drive means for moving the slips radially inwardly into a pipe gripping position and radially outwardly to a pipe releasing position, and an attachment means for connecting the clamp to a top drive for wellbore drilling.

2. The casing clamp of claim 1 further comprising slip dies mounted on the slips.

3. The casing clamp of claim 2 wherein the slip dies include a gripping surface, the gripping surface formed to facilitate engagement with a pipe.

4. The casing clamp of claim 1 further comprising a slip bowl including a conical bore formed therethrough, the slips being mounted in the slip bowl and constrained to move along the conical taper of the slip bowl to move radially inward and outward relative to the centre axis of the slip bowl.

5. The casing clamp of claim 4 wherein the conical bore tapers downwardly.

6. The casing clamp of claim 1 wherein the drive means includes a biasing agent for biasing the slips into a pipe gripping position.

7. The casing clamp of claim 5 wherein the drive means includes a biasing agent for biasing the slips down along the taper of the slip bowl such that they are normally in a pipe gripping, closed position.

8. The casing clamp of claim 1 wherein the drive means includes a hydraulic system.

9. The casing clamp of claim 1 further comprising a stabbing spear extending out between the slips and formed to fit within a pipe to be gripped by the clamp.

10. The casing clamp of claim 1 further comprising a drilling fluid conduit for conducting a flow of drilling fluid from the top drive.

11. The casing clamp of claim 9 wherein the stabbing spear includes a drilling fluid conduit for conducting a flow of drilling fluid from the top drive.

12. A clamp for use with a top drive for gripping and turning a drill string formed of pipe, the clamp comprising: slips positioned to grip and support the pipe, drive means including a hydraulic system for moving the slips radially inwardly into a pipe gripping position and radially outwardly to a pipe releasing position, and an attachment means for connecting the clamp to a top drive.

13. The casing clamp of claim 12 further comprising slip dies mounted on the slips.

14. The casing clamp of claim 13 wherein the slip dies include a gripping surface, the gripping surface formed to facilitate engagement with a pipe.

15. The casing clamp of claim 12 further comprising a slip bowl including a conical bore formed therethrough, the slips being mounted in the slip bowl and constrained to move along the conical taper of the slip bowl to move radially inward and outward relative to the centre axis of the slip bowl.

16. The casing clamp of claim 15 wherein the conical bore tapers downwardly.

17. The casing clamp of claim 12 wherein the drive means further includes a biasing agent for biasing the slips into a pipe gripping position.

18. The casing clamp of claim 16 wherein the drive means further includes a biasing agent for biasing the slips down along the taper of the slip bowl such that they are normally in a pipe gripping, closed position.

19. The casing clamp of claim 12 further comprising a stabbing spear extending out between the slips and formed to fit within the pipe to be gripped by the clamp.

20. The casing clamp of claim 12 further comprising a drilling fluid conduit for conducting a flow of drilling fluid from the top drive.

21. The casing clamp of claim 19 wherein the stabbing spear includes a drilling fluid conduit for conducting a flow of drilling fluid from the top drive.

22. A clamp for use with a top drive for gripping and turning a drill string formed of pipe, the clamp comprising: slips positioned to grip and support the pipe, drive means for moving the slips radially inwardly into a pipe gripping position and radially outwardly to a pipe releasing position, a stabbing spear extending out between the slips and formed to fit within the pipe to be gripped by the clamp and an attachment means for connecting the clamp to a top drive.

23. The casing clamp of claim 22 further comprising slip dies mounted on the slips.

24. The casing clamp of claim 23 wherein the slip dies include a gripping surface, the gripping surface formed to facilitate engagement with a pipe.

25. The casing clamp of claim 22 further comprising a slip bowl including a conical bore formed therethrough, the slips being mounted in the slip bowl and constrained to move along the conical taper of the slip bowl to move radially inward and outward relative to the centre axis of the slip bowl.

26. The casing clamp of claim 25 wherein the conical bore tapers downwardly.

27. The casing clamp of claim 22 wherein the drive means includes a biasing agent for biasing the slips into a pipe gripping position.

28. The casing clamp of claim 26 wherein the drive means includes a biasing agent for biasing the slips down along the taper of the slip bowl such that they are normally in a pipe gripping, closed position.

29. The casing clamp of claim 22 wherein the drive means includes a hydraulic system.

30. The casing clamp of claim 22 further comprising a drilling fluid conduit for conducting a flow of drilling fluid from the top drive.

31. The casing clamp of claim 22 wherein the stabbing spear includes a drilling fluid conduit for conducting a flow of drilling fluid from the top drive.

32. The casing clamp of claim 31 wherein the stabbing spear includes a seal disposed thereabout to seal between the stabbing spear and the pipe to be gripped.

* * * * *